US011524880B2

(12) United States Patent
Okumura

(10) Patent No.: US 11,524,880 B2
(45) Date of Patent: Dec. 13, 2022

(54) FORKLIFT AND METHOD FOR DETECTING POSTURE OF CONTAINER

(71) Applicant: KABUSHIKI KAISHA TOYOTA JIDOSHOKKI, Kariya (JP)

(72) Inventor: Shunsuke Okumura, Kariya (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 150 days.

(21) Appl. No.: 17/010,249

(22) Filed: Sep. 2, 2020

(65) Prior Publication Data

US 2021/0070593 A1 Mar. 11, 2021

(30) Foreign Application Priority Data

Sep. 5, 2019 (JP) ..... JP2019-162129

(51) Int. Cl.
*B66F 9/075* (2006.01)
*B66F 9/08* (2006.01)

(52) U.S. Cl.
CPC ..... *B66F 9/0755* (2013.01); *B66F 9/082* (2013.01)

(58) Field of Classification Search
CPC ..... B66F 9/0875; B66F 9/082
See application file for complete search history.

(56) References Cited

U.S. PATENT DOCUMENTS

| | | | | |
|---|---|---|---|---|
| 6,398,480 | B1 * | 6/2002 | Baginski | B66F 9/082 180/209 |
| 8,157,500 | B1 * | 4/2012 | Husmann | B66F 9/0755 414/642 |
| 2013/0084153 | A1 * | 4/2013 | Nishiwaki | B66F 9/24 414/629 |
| 2016/0031689 | A1 * | 2/2016 | Cook | B66F 9/082 414/642 |
| 2019/0119084 | A1 * | 4/2019 | Pautz | B66F 9/0755 |
| 2019/0276290 | A1 * | 9/2019 | Parent | B66F 9/082 |
| 2020/0031642 | A1 * | 1/2020 | Uchimura | B60Q 9/00 |
| 2020/0031645 | A1 * | 1/2020 | Uchimura | B66F 9/082 |
| 2021/0285757 | A1 * | 9/2021 | Ogasawara | G01B 11/14 |
| 2021/0395063 | A1 * | 12/2021 | Hattori | B66F 9/082 |
| 2021/0403298 | A1 * | 12/2021 | Capron | G05B 19/4155 |
| 2022/0002126 | A1 * | 1/2022 | Pappi | B66F 9/07572 |

FOREIGN PATENT DOCUMENTS

| | | | |
|---|---|---|---|
| CN | 112744741 A | * | 5/2021 |
| JP | 2017-204043 A | | 11/2017 |
| JP | 2018-158779 A | | 10/2018 |

* cited by examiner

*Primary Examiner* — Kaitlin S Joerger
(74) *Attorney, Agent, or Firm* — Sughrue Mion, PLLC

(57) ABSTRACT

A forklift includes a vehicle body, a loading device, a laser rangefinder, a first extractor configured to extract detection point candidates, a memory that stores at least one of dimension information, position information, and posture information of a container, a second extractor configured to extract at least two posture detection points by checking the detection point candidates against at least one of the dimension information, the position information, and the posture information, and a container posture detector configured to detect a relative angle between the forklift and the container in a vertical direction.

8 Claims, 6 Drawing Sheets

FORKLIFT AND METHOD FOR DETECTING POSTURE OF CONTAINER

BACKGROUND

1. Field

The present disclosure relates to a forklift and a method for detecting the posture of a container.

2. Description of Related Art

For cargo transportation, a container capable of being loaded with a cargo is used. A forklift transports a cargo to a container. The forklift includes forks that lift and lower the cargo. The container includes a door capable of opening and closing an opening. The forklift loads the cargo into the container through the opening. More specifically, the forks loaded with the cargo are inserted from the opening, and the forks are then lowered in the container. At this time, a large relative angle between the forklift and the container in the vertical direction causes the forks or cargo to unintentionally contact the bottom of the container or makes the cargo unstable. As a result, cargo loading may not be able to be performed smoothly.

In order to prevent such an unintended contact and prevent the cargo from becoming unstable, the forks need to be tilted in correspondence with the relative angle between the forklift and the container in the vertical direction. Japanese Laid-Open Patent Publication No. 2017-204043 describes an example of a marker used to obtain the relative angle. In the publication, the marker is arranged in a section where an autonomous movable body is used for self-localization of the autonomous movable body. The autonomous movable body includes a detector that detects the marker and self-localizes by detecting the marker.

To obtain the relative angle using the marker, the marker is arranged at the container and the detector capable of detecting the marker is arranged at the forklift. For example, markers are arranged at two positions of the container, and the distances to the two markers are detected by the detector. This allows the relative angle between the forklift and the container in the vertical direction to be obtained.

When multiple containers are provided, it takes time and effort to attach markers to each container. Further, when the attachment accuracy of the markers is low, the relative angle cannot be obtained accurately.

SUMMARY

It is an object of the present disclosure to provide a forklift capable of detecting the relative angle between a forklift and a container in the vertical direction and a method for detecting the posture of the container.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

A forklift according to an aspect of the present disclosure includes a vehicle body, a loading device capable of being tilted toward the vehicle body, a laser rangefinder configured to radiate a laser toward a front side of the loading device while changing a radiation angle with respect to a vertical direction and measure, in correspondence with the radiation angle, a distance to each of radiation points in a group of radiation points that have been struck by the laser, a first extractor configured to extract detection point candidates from the group of radiation points in a load state in which a container on the front side of the loading device is loaded with a cargo, the detection point candidates being candidates of at least two posture detection points, an inclination of a straight line that connects the posture detection points changing in accordance with an inclination of the container in the vertical direction, a memory that stores at least one of dimension information of the container, position information of the container, and posture information of the container, a second extractor configured to extract the posture detection points from the detection point candidates by checking the detection point candidates against at least one of the dimension information, the position information, and the posture information, and a container posture detector configured to detect a relative angle between the forklift and the container in the vertical direction from the inclination of the straight line.

A method for detecting a posture of a container according to an aspect of the present disclosure detects a relative angle between a forklift and the container in a vertical direction. The method includes radiating a laser from the forklift toward the container while changing an radiation angle with respect to the vertical direction and measuring, in correspondence with the radiation angle, a distance to each of radiation points in a group of radiation points that have been struck by the laser; extracting detection point candidates from the group of radiation points, extracting at least two posture detection points from the detection point candidates by checking the detection point candidates against at least one of dimension information of the container, position information of the container, and posture information of the container, an inclination of a straight line that connects the posture detection points changing in accordance with an inclination of the container in the vertical direction, and detecting the relative angle between the forklift and the container in the vertical direction from the inclination of the straight line.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

A forklift 10 and a method for detecting the posture of a container C according to an embodiment will now be described.

Figure 1:
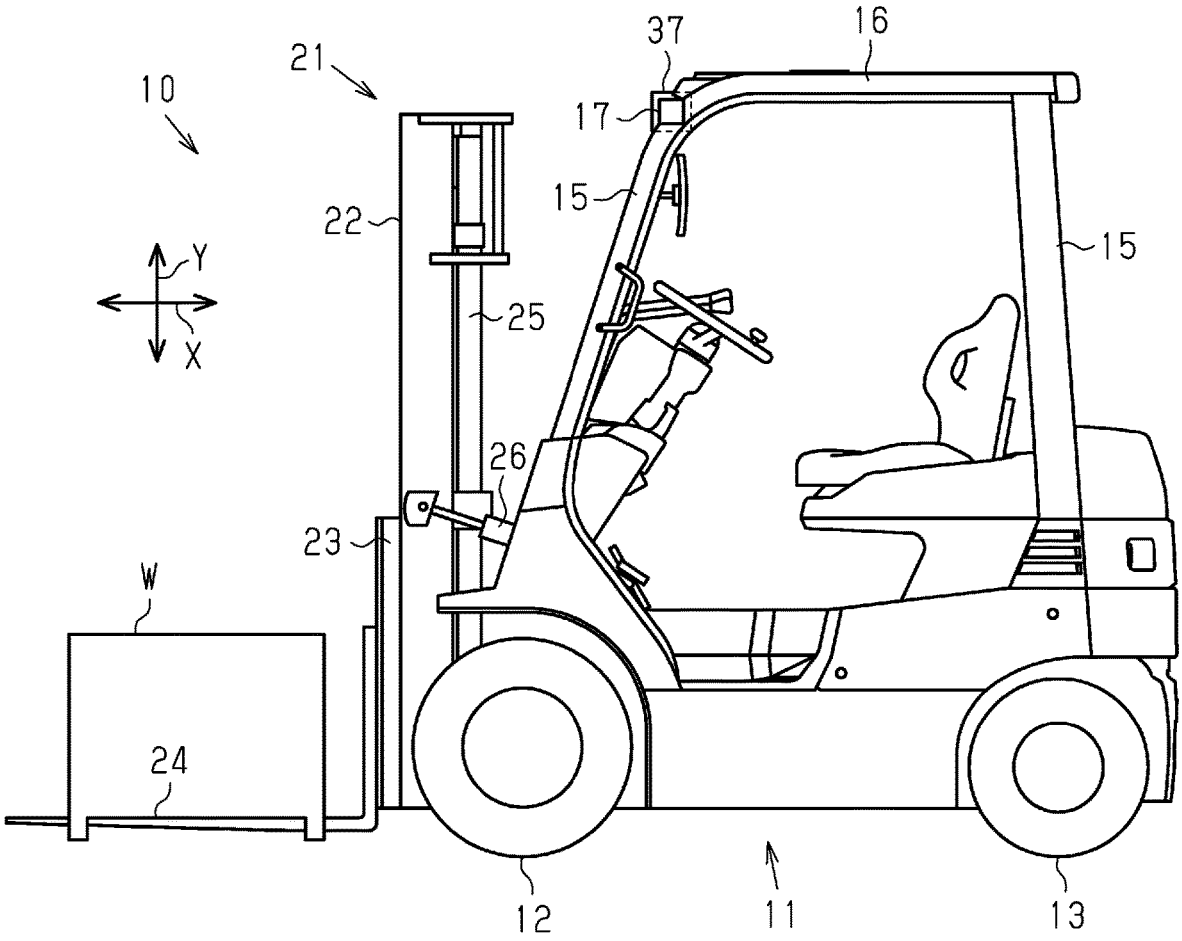
FIG. 1 is a side view schematically showing a forklift according to an embodiment.
Figure 2:
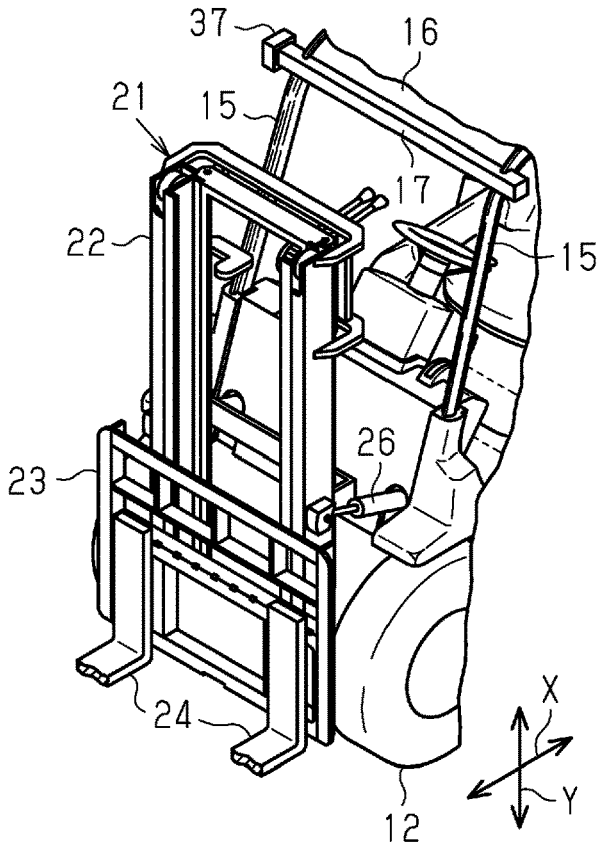
FIG. 2 is a perspective view, with a part cut away, showing a part of the forklift in FIG. 1.

As shown in FIGS. 1 and 2, the forklift 10 includes a vehicle body 11, multiple (two) drive wheels 12, which are arranged on the front lower part of the vehicle body 11, multiple (two) steerable wheels 13, which are arranged on the rear lower part of the vehicle body 11, multiple pillars 15, a head guard 16, which is supported by the pillars 15, and an attachment portion 17. The pillars 15 extend upward from the vehicle body 11. The attachment portion 17 extends in the width direction and is attached to the front pillars 15, which are laid out in the width direction. The opposite ends of the attachment portion 17 protrude outward from the corresponding pillars 15 in the width direction.

The forklift 10 includes a loading device 21, which is arranged in front of the vehicle body 11. The loading device 21 is located frontward from the head guard 16. The loading device 21 includes two masts 22, which are arranged upright at the front part of the vehicle body 11, a lift bracket 23, which is fixed to the masts 22, and forks 24, which are fixed to the lift bracket 23. The forks 24 are loaded with a cargo W. In the present embodiment, the cargo W is a pallet that accommodates a conveyance object. The pallet may be of any type such as a mesh pallet or a flat pallet. The front side of the loading device 21 coincides with the front side of the vehicle body 11. The front side of the loading device 21 faces the direction in which the forks 24 extend. The loading device 21 includes a lift cylinder 25, which lifts and lowers the masts 22. The loading device 21 includes two tilt cylinders 26, which respectively tilt the two masts 22. Driving the tilt cylinders 26 tilts the loading device 21 relative to the vehicle body 11. The lift cylinder 25 and the tilt cylinders 26 are hydraulic cylinders.

Figure 3:
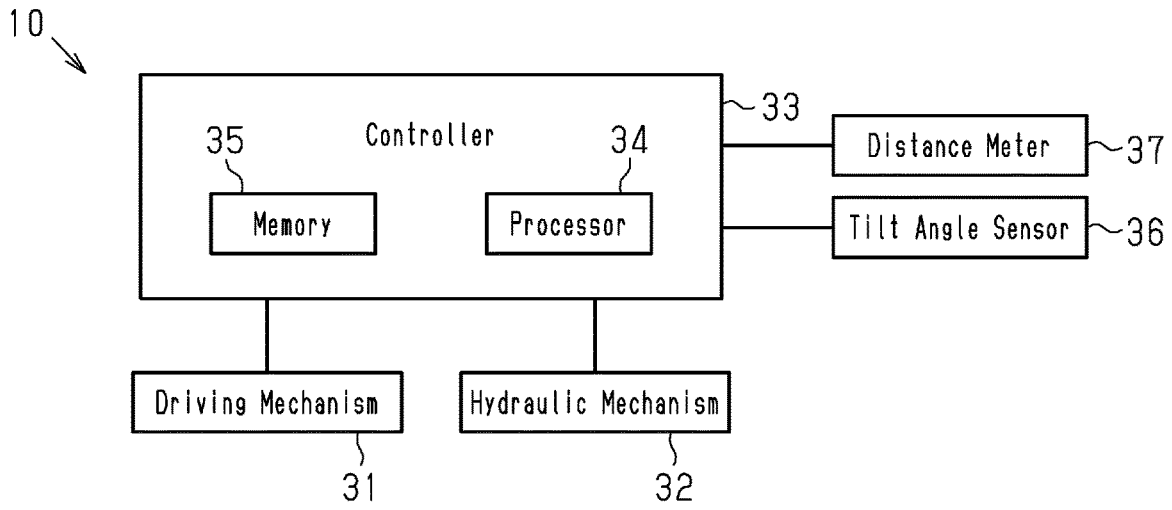
FIG. 3 is a diagram schematically showing the configuration of the forklift in FIG. 1.

As shown in FIG. 3, the forklift 10 includes a driving mechanism 31, a hydraulic mechanism 32, a controller 33, a tilt angle sensor 36, and a distance meter 37. The driving mechanism 31 causes the forklift 10 to travel. The driving mechanism 31 includes a travel motor used to drive the drive wheels 12 and a steering mechanism used to steer the steerable wheels 13. The hydraulic mechanism 32 controls the supplying and discharging of hydraulic oil to and from the lift cylinder 25 and the tilt cylinders 26. The hydraulic mechanism 32 includes a loading motor used to drive a pump and includes a control valve. The tilt angle sensor 36 detects the tilt angle of the loading device 21. The tilt angle is the angle of the loading device 21 in a case where the angle when the surface on which the forklift 10 is arranged and the upper surfaces of the forks 24 are parallel to each other is 0°, which is a reference. The tilt angle sensor 36 is, for example, a potentiometer.

The distance meter 37 is a laser rangefinder capable of recognizing the surrounding environment by radiating a laser to the surroundings and receiving a reflection light that has been reflected on a radiation point on a target struck by the laser. In the present embodiment, the distance meter 37 is a two-dimensional laser rangefinder that radiates a laser while changing the radiation angle with respect to a single direction. The distance meter 37 is attached so as to radiate a laser toward the front side of the vehicle body 11 while changing the radiation angle with respect to the vertical direction. The distance meter 37 is arranged such that a laser is radiated toward the front side without the laser striking the loading device 21. In other words, the distance meter 37 is arranged so as not to overlap the loading device 21 in the front-rear direction (i.e., a travel direction of the forklift 10). As shown in FIG. 2, the distance meter 37 is attached to an end of the attachment portion 17 in the width direction. Thus, the distance meter 37 is located outward from the loading device 21 in the width direction.

The distance meter 37 measures the distance to each of a group of radiation points struck by a laser in correspondence with their radiation angles. That is, the distance meter 37 is capable of measuring the relative coordinates of the distance meter 37 and each radiation point. The relative coordinates are in a two-dimensional orthogonal coordinate system in which the position of the distance meter 37 is an origin. The relative coordinates have an X-axis extending in the travel direction of the forklift 10 (front-rear direction) and a Y-axis extending in the vertical direction. In the drawings, the direction in which the X-axis extends is indicated by arrow X, and the direction in which the Y-axis extends is indicated by arrow Y. The X-axis extends in parallel to the surface where the forklift 10 is arranged. The Y-axis is orthogonal to the surface where the forklift 10 is arranged. When the forklift 10 is arranged on a horizontal surface (i.e., a surface with the inclination of 0°), the X-axis extends horizontally. The distance meter 37 outputs a measurement result to the controller 33. The measurement result of the distance meter 37 includes the relative coordinates (X, Y) of a radiation point.

As shown in FIG. 3, the controller 33 includes a processor 34 and a memory 35. The memory 35 stores various programs used to control the forklift 10. The controller 33 may include dedicated hardware such as application specific integrated circuit (ASIC) that executes at least part of various processes. The controller 33 may be circuitry including one or more processors that operate according to a computer program, one or more dedicated hardware circuits such as an ASIC, or a combination thereof. The processor includes a CPU and memory such as a RAM and ROM. The memory stores program codes or instructions configured to cause the CPU to execute processes. The memory, or computer readable medium, includes any type of medium that is accessible by general-purpose computers and dedicated computers.

The controller 33 controls the driving mechanism 31 and the hydraulic mechanism 32 in accordance with the programs stored in the memory 35 to operate the forklift 10. In the present embodiment, the forklift 10 automatically executes traveling, steering, and loading through the control of the controller 33 without operation performed by an occupant.

Figure 4:
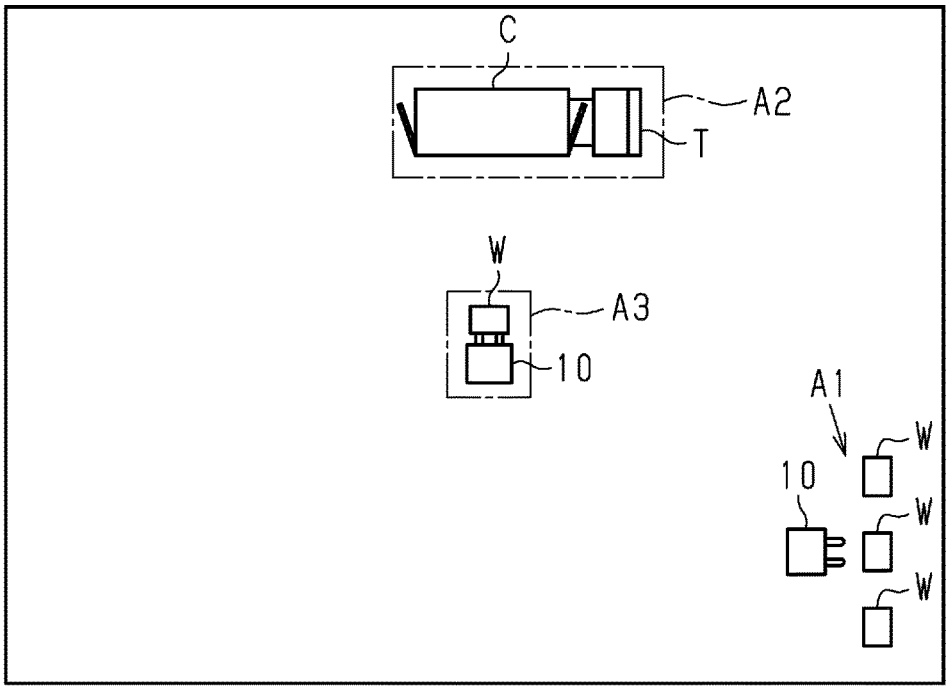
FIG. 4 is a diagram schematically showing a work area where the forklift in FIG. 1 is used.

As shown in FIG. 4, the forklift 10 is used in a work area where the cargo W needs to be carried, such as a factory or port. The work area includes a first position A1, where the cargo W is placed, a second position A2, where the container C is arranged, and a third position A3, where the forklift 10 is in a load state in which the forklift 10 loads the container C with the cargo W.

The forklift 10 carries, to the container C, the cargo W at the first position A1 and loads the container C with the cargo W. When loading the container C with the cargo W, the forklift 10 loads the forks 24 with the cargo W at the first position A1 and then moves to the third position A3. The forklift 10 moves from the first position A1 to the third position A3 such that the front side of the loading device 21 is oriented toward the second position A2 when the forklift 10 arrives at the third position A3.

The memory 35 of the controller 33 stores map information. The map information indicates an environment map, the coordinates of the first position A1, the coordinates of the second position A2, and the coordinates of the third position A3. The environment map is the information related to the physical structure of the surrounding environment of the forklift 10 including the shape and size of the environment where the forklift 10 is used. The coordinates of the second position A2 and the coordinates of the third position A3 are set in the environment map.

In a case where the forklift 10 has acknowledged in advance the surrounding environment where the forklift 10 is used, the environment map may be stored in the memory 35 in advance. When the environment map is stored in the memory 35, the information that should be stored includes the coordinates of an object that is unlikely to change in position such as the wall or pillar of a building. The environment map may be created through mapping using simultaneous localization and mapping (SLAM).

In mapping, for example, multiple local maps are created on the basis of multiple coordinates obtained using an environment sensor such as a camera or scanning range sensor, and the local maps are combined in correspondence with self-positions. The distance meter 37 may be used as the environment sensor.

The controller 33 is capable of moving the forklift 10 to the third position A3 by controlling the driving mechanism 31 while executing self-localization, which estimates the position of the forklift 10 on the environment map. In self-localization, a Bayesian filter is used to integrate odometry with the matching result of a landmark and the environment map. In odometry, for example, the rotation speed of the travel motor is used to estimate the amount of egomotion of the forklift 10. That is, the controller 33 executes probabilistic self-localization, which estimates a self-position obtained through the odometry by correcting the self-position with the position relative to the landmark. Instead, as long as the forklift 10 is used in an outdoor environment, a self-position may be estimated using a global navigation satellite system (GNSS) such as a global positioning system (GPS). The self-position refers to the coordinates indicating a single point of the vehicle body 11, for example, the coordinates of the center of the vehicle body 11 in the horizontal direction.

The container C is transported to the third position A3 by, for example, a container truck T.

Figure 5:
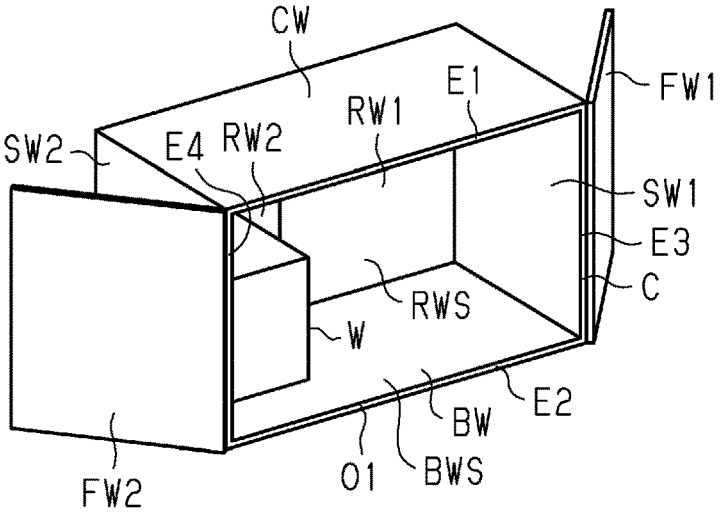
FIG. 5 is a perspective view showing the container.
Figure 6:
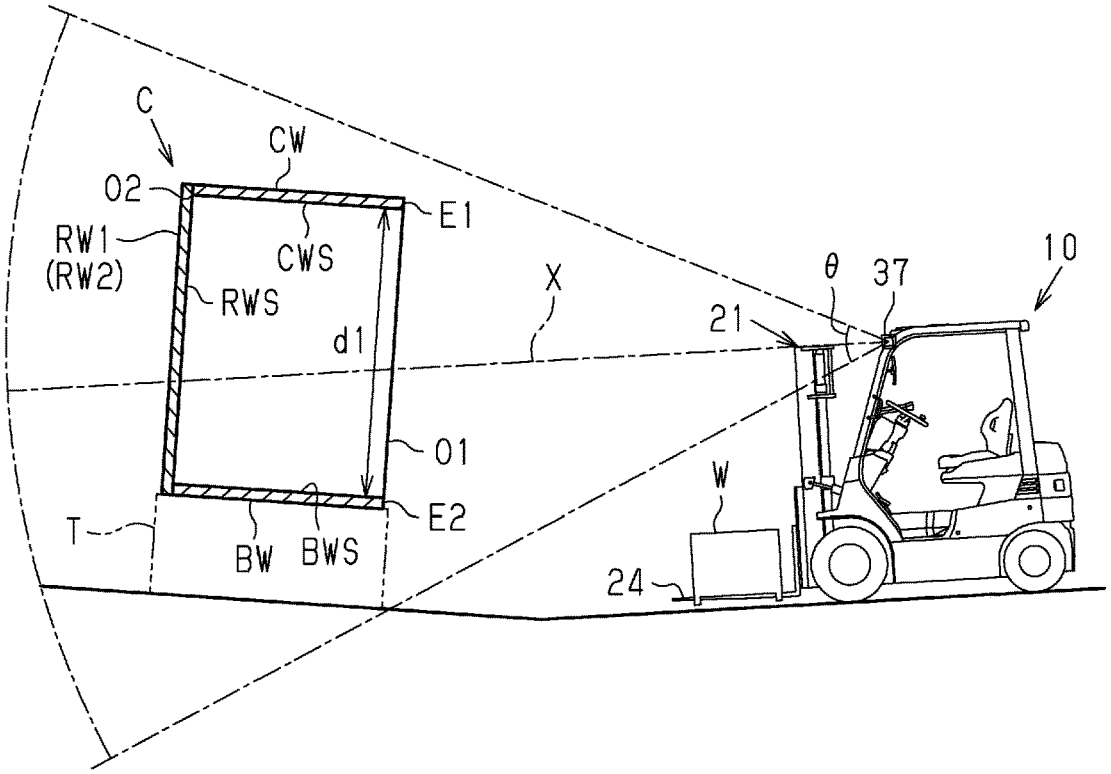
FIG. 6 is a side view showing the forklift in FIG. 1 and the container in FIG. 5.

As shown in FIGS. 5 and 6, the container C is hollow and includes an accommodation space that accommodates the cargo W. The container C includes a bottom BW, a ceiling CW, two front walls FW1 and FW2, two rear walls RW1 and RW2, and two side walls SW1 and SW2. The bottom BW, the ceiling CW, the front walls FW1 and FW2, the rear walls RW1 and RW2, and the side walls SW1 and SW2 are all, for example, quadrilateral walls. The bottom BW and the ceiling CW are faced with each other. The front walls FW1 and FW2, the rear walls RW1 and RW2, and the side walls SW1 and SW2 are located between the bottom BW and the ceiling CW. The two side walls SW1 and SW2 are faced with each other. The two front walls FW1 and FW2 and the two rear walls RW1 and RW2 are faced with each other. The front wall FW1 is pivotally attached to the side wall SW1 by, for example, a hinge. The front wall FW2 is pivotally attached to the side wall SW2 by, for example, a hinge. The rear wall RW1 is pivotally attached to the side wall SW1 by, for example, a hinge. The rear wall RW2 is pivotally attached to the side wall SW2 by, for example, a hinge. The front walls FW1 and FW2 and the rear walls RW1 and RW2 are capable of being opened and closed. The bottom BW, the ceiling CW, and the side walls SW1 and SW2 define a rectangular first opening O1 and a rectangular second opening O2. Pivoting the front walls FW1 and FW2 switches the first opening O1 between an open state and a closed state. The first opening O1 is defined by four edges, namely, an edge E1 of the ceiling CW, an edge E2 of the bottom BW, an edge E3 of the side wall SW1, and an edge E4 of the side wall SW2. The edge E1 and the edge E2 are spaced apart from each other in the vertical direction. Pivoting the rear walls RW1 and RW2 switches the second opening O2 to an open state and a closed state. The cargo W is taken out of and put into the first opening O1. The container C may be of any type as long as the container C accommodates the container C. The container C may have any shape as long as the container C is capable of accommodating the container C. For example, the container C may be shaped such that the ceiling CW is not provided or the rear walls RW1 and RW2 do not open.

The container C is a container for refrigeration use. The container C includes a specular inner surface.

The memory 35 stores, as the information of the container C, dimension information, position information, and posture information. The dimension information includes the dimension of the container C. In the present embodiment, the dimension information is a dimension d1 between the edge E1 and the edge E2. The dimension d1 is the length of a line segment connecting the edge E1 and the edge E2 by the shortest distance. For example, like the dimension of the front walls FW1 and FW2 in the vertical direction, the dimension similar to the dimension d1 may be set as the dimension information. The position information indicates the position where the container C is arranged. That is, the position information refers to the coordinates of the second position A2. The posture information indicates the posture of the container C. The posture of the container C indicates in what posture the container C is arranged at the second position A2. Examples of the posture of the container C include the inclination angle of the container C in the vertical direction and the orientation of the first opening O1 of the container C.

In the present embodiment, in the walls of the container C that are capable of being opened and closed, the walls located close to the forklift 10 in a state where the forklift 10 is faced with the container C are referred to as the front walls FW1 and FW2, and the walls located farther away from the forklift 10 than the front walls FW1 and FW2 are referred to as the rear walls RW1 and RW2. Accordingly, the positional relationship between the forklift 10 and the container C determines whether the walls capable of being opened and closed are the front walls FW1 and FW2 or the rear walls RW1 and RW2. The walls extending between the front walls FW1 and FW2 and the rear walls RW1 and RW2 are the side walls SW1 and SW2. The container C is arranged such that the front walls FW1 and FW2, which are the walls capable of being opened and closed, are oriented toward the third position A3.

When arriving at the third position A3, the forklift 10 enters the load state. In the load state, the container C arranged in front of the loading device 21 is loaded with the cargo W. In the load state, the forklift 10 loads the container C with the cargo W while adjusting the positional relationship with the container C.

As shown in FIG. 6, the surface on which the container C is arranged and the surface on which the forklift 10 is arranged may have different inclinations. In this case, as compared with when the surface on which the container C is arranged and the surface on which the forklift 10 is arranged have the same inclination, the relative angle between the forklift 10 and the container C in the vertical direction is large. In the following description, the relative angle between the forklift 10 and the container C in the vertical direction may be simply referred to as the "relative angle." In the present embodiment, the relative angle is a deviation angle in the vertical direction between the X-axis and an inner surface BWS of the bottom BW, which is a surface where the cargo W is mounted. In other words, the inclination angle of the inner surface BWS with respect to the travel direction of the forklift 10 as the forklift 10 is viewed in the width direction is the relative angle between the forklift 10 and the container C in the vertical direction. When the X-axis and the inner surface BWS are parallel to each other, the relative angle is 0°. In a case where the surface on which the container C is arranged and the surface on which the forklift 10 is arranged have the same inclination, the relative angle may be large if the condition including the loading situation of the cargo W is different. For example, when the cargo W is accommodated in the container C on the bed of the container truck T, the load of the cargo W shrinks the suspensions or tires of the container truck T to incline the container truck T. This may increase the relative angle.

The process executed by the controller 33 when the forklift 10 is in the load state will now be described together with the method for detecting the posture of the container C. When the forklift 10 loads the container C with the cargo W, the front walls FW1 and FW2 are opened. This keeps the first opening O1 open and allows the container C to be loaded with the cargo W through the first opening O1. A case where the container C in the state shown in FIG. 7 is loaded with the cargo W will now be described as an example.

Figure 7:
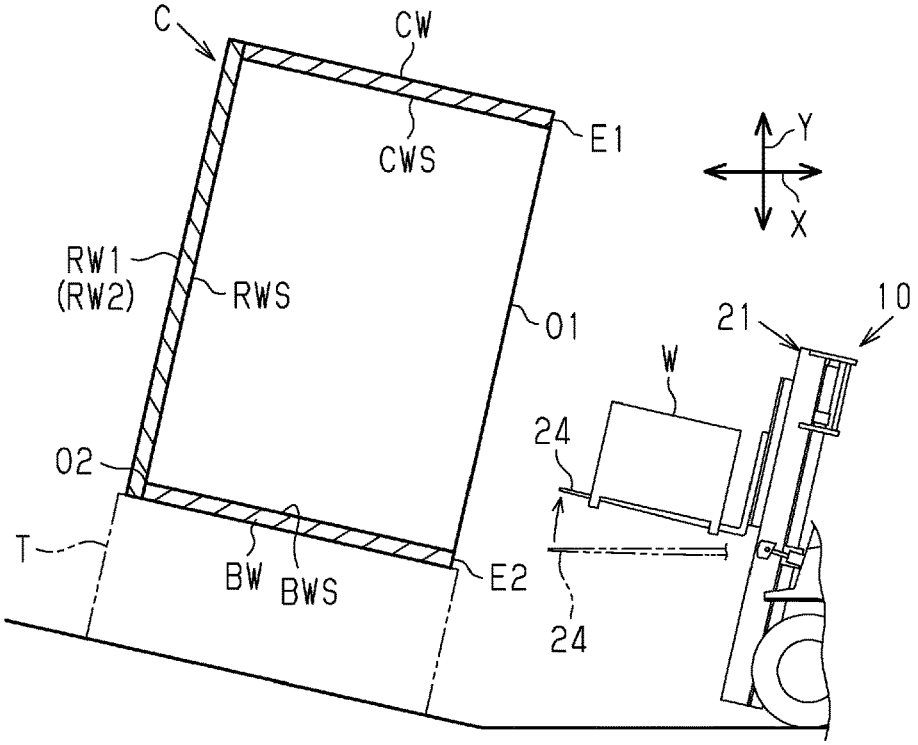
FIG. 7 is a diagram illustrating a process performed when the forklift in FIG. 1 is in a load state.

As shown in FIG. 7, the surface on which the forklift 10 is arranged and the surface on which the container C is arranged have different inclinations. The surface on which the container C is arranged is inclined upward in the direction in which the forklift 10 advances.

When the forklift 10 enters the load state, the controller 33 brings the forklift 10 close to the container C and lifts the forks 24 above the inner surface BWS of the bottom BW. Various control modes may be used to bring the forklift 10 close to the container C and lift the forks 24. For example, the distance meter 37 and a sensor that differs from the distance meter 37 are used to control the driving mechanism 31 while acknowledging the relative position of the forklift 10 and the container C so that the forklift 10 is brought close to the container C. For example, the distance meter 37 and a sensor that differs from the distance meter 37 are used to detect the height of the inner surface BWS of the bottom BW and control the hydraulic mechanism 32 such that the forks 24 are lifted above the height, thereby lifting the fork 24. Additionally, the controller 33 detects the relative angle between the forklift 10 and the container C in the vertical direction.

Figure 8:
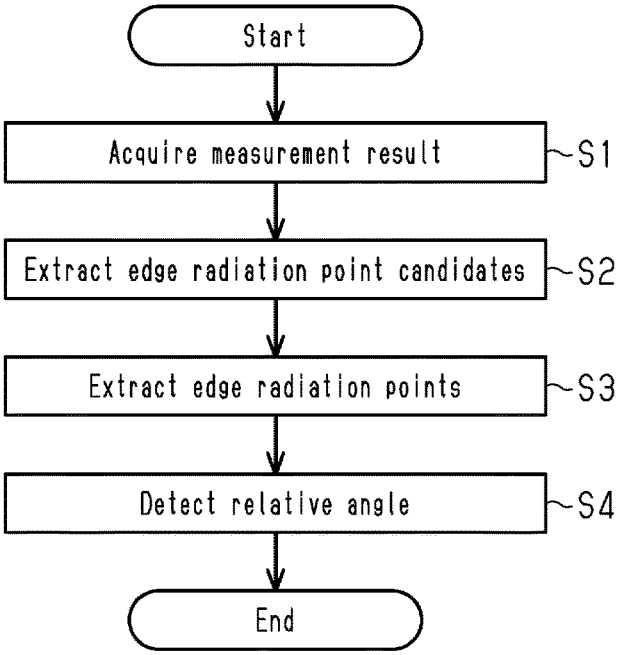
FIG. 8 is a flowchart illustrating a process performed by the controller when the forklift in FIG. 1 is in the load state.
Figure 9:
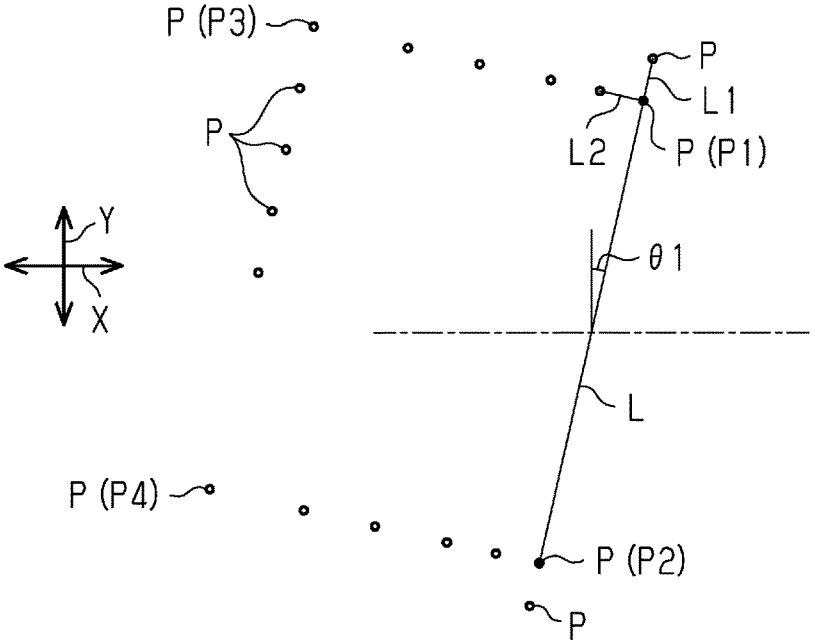
FIG. 9 is a diagram schematically showing radiation points when a laser is radiated to the container in FIG. 5.

As shown in FIG. 8, in step S1, the controller 33 acquires the measurement result of the distance meter 37. A case where the coordinates of a group of radiation points P shown in FIG. 9 are acquired by radiating a laser to the container C of the present embodiment will now be described as an example. As shown in FIG. 6, a laser-radiation range θ is set such that the laser is radiated to the entire container C with respect to the vertical direction.

As shown in FIGS. 8 and 9, in step S2, the controller 33 extracts several edge radiation point candidates P1 to P4 from the group of radiation points P. The edge radiation point candidates P1 to P4 are the candidates of edge radiation points P1 and P2. The edge radiation points P1 and P2 are the radiation points P on the edges E1 and E2. The inclination of the straight line connecting the edge radiation points P1 and P2 changes in accordance with the inclination of the container C in the vertical direction. For example, as the container C inclines in the front-rear direction with respect to the vertical direction, the straight line connecting the edge radiation points P1 and P2 incline in the front-rear direction in the same manner. As the container C inclines in the front-rear direction with respect to the vertical direction, the positional relationship between the two edges E1 and E2 faced with each other in the vertical direction changes in accordance with the inclination of the container C. When the container C is not inclined in the vertical direction, the straight line connecting the edges E1 and E2 is orthogonal to the horizontal surface. When the container C is inclined in the vertical direction, the straight line connecting the edges E1 and E2 is inclined relative to the horizontal surface. Accordingly, the inclination of the straight line connecting the edge radiation points P1 and P2 changes in accordance with the inclination of the container C in the vertical direction. The edge radiation points P1 and P2 are posture detection points, and the edge radiation point candidates P1 to P4 are detection point candidates.

When the inner surface is a specular surface, the laser incident on the inner surface of the container C tends to be specularly reflected. This increases the number of radiation angles at which the radiation point P cannot be acquired. Thus, in the present embodiment, as compared with a container C of which the inner surface is not specular, a small number of the radiation points P can be gained. The laser is easily incident perpendicularly on the edges E1 and E2. Accordingly, the edge radiation points P1 and P2 on the edges E1 and E2 can be easily acquired.

The edge radiation point candidates P1 to P4 are extracted by, for example, comparing adjacent ones of the radiation points P. The edges E1 and E2 have a small dimension in the vertical direction, and the number of the radiation points P on the edges E1 and E2 is small. Thus, in many cases, the radiation points P adjacent to the edge radiation point P1 on the edge E1 are located on the ceiling CW. In many cases, the radiation points P adjacent to the edge radiation point P2 on the edge E2 are located on the bottom BW. While the radiation points P on the same surface are easily laid out in a row, the radiation points P on different surfaces are not easily laid out in a row. Accordingly, among multiple line segments obtained by connecting adjacent ones of the radiation points P of the group of radiation points P on the container C, two line segments of which the intersections are the edge radiation points P1 and P2 on the edges E1 and E2 have inclination angles that greatly differ from each other. In other words, the two line segments obtained by connecting the edge radiation point P1 and its adjacent radiation points P have inclinations that greatly differ from each other. Likewise, the two line segments obtained by connecting the edge radiation point P2 and its adjacent radiation points P have inclinations that greatly differ from each other.

Description will now be made using the edge radiation point P1 as an example. When a laser is radiated from top toward bottom, the line segment connecting the edge radiation point P1 and a first radiation point P, which is the previous one, is referred to as a line segment L1, and the line segment connecting the edge radiation point P1 and a second radiation point P, which is the subsequent one, is referred to as a line segment L2. The inclination of the line segment L2 changes to a larger extent than that of the line segment L1. Accordingly, a threshold value simply needs to be set for the change amount of the inclination, and the radiation points P of which the inclinations change to the threshold value or larger simply need to be determined as the edge radiation point candidates P1 to P4. Alternatively, a threshold value may be set for the inclination angle of the line segment connecting two adjacent radiation points P with respect to the X-axis or the Y-axis, and the edge radiation point candidates P1 to P4 may be extracted from the inclination angle. In the example shown in FIG. 9, four edge radiation point candidates P1 to P4 are extracted. By executing the process of step S2, the controller 33 is used as a first extractor.

Next, in step S3, the controller 33 extracts the edge radiation points P1 and P2 from the edge radiation point candidates P1 to P4. The edge radiation points P1 and P2 are extracted by checking all of the edge radiation point candidates P1 to P4 against the dimension information, the position information, and the posture information stored in the memory 35.

The controller 33 calculates the separation distances of all of the pairs of the edge radiation point candidates P1 to P4. The controller 33 compares the calculated separation distances with the dimension d1, which is the dimension information. The controller 33 determines that a pair of the radiation points P where the difference between the dimension d1 and the separation distance of the edge radiation point candidates P1 to P4 is within an allowable range are two edge radiation points. The allowable range is set taking into account, for example, one or more conditions including the measurement accuracy of the separation distance of the edge radiation point candidates P1 to P4. In the example shown in FIG. 9, it is determined that the edge radiation point candidates P1 and P2 or the edge radiation point candidates P3 and P4 are edge radiation points.

The controller 33 compares the distance from the forklift 10 to each of the edge radiation point candidates P1 to P4 with the position of the container C indicated by the position information. Using the position information, the controller 33 is capable of calculating a possible range of the distance from the forklift 10 to each of the edges E1 and E2 of the container C. The controller 33 determines that the edge radiation point candidates P1 to P4 where the distance from the forklift 10 is within the possible range of the above-described distance are edge radiation points. In the example shown in FIG. 9, the controller 33 determines that the edge radiation point candidates P1 and P2 are edge radiation points.

The controller 33 calculates the inclination angle of line segments connecting to each other for all of the pairs of the four edge radiation point candidates P1 to P4. The inclination angle of a line segment refers to the inclination angle of a line segment with respect to the X-axis or the Y-axis. The controller 33 is capable of acknowledging a possible range of the inclination angle of the line segment connecting the edges E1 and E2 from the posture information. The controller 33 determines that a pair of radiation points P where the inclination angle of the line segments connecting to each other is within the possible range of the inclination angle of the line segment connecting the edges E1 and E2 are two edge radiation points. In the example shown in FIG. 9, the controller 33 determines that the edge radiation point candidates P1 and P2 or the edge radiation point candidates P3 and P4 are edge radiation points.

In the present embodiment, as a result of checking the edge radiation point candidates P1 to P4 against the dimension information, the position information, and the posture information, the edge radiation point candidates P1 and P2 matching all of the conditions are extracted as the edge radiation points P1 and P2. By executing the process of step S3, the controller 33 is used as a second extractor.

Subsequently, in step S4, the controller 33 detects the relative angle between the forklift 10 and the container C in the vertical direction. The relative angle is calculated from the inclination of a straight line L, which connects the edge radiation points P1 and P2. When the relative angle is 0°, the straight line L is orthogonal to the X-axis. Thus, the inclination angle θ1 of the straight line L with respect to the Y-axis, which is orthogonal to the X-axis, is the relative angle. The controller 33 calculates the inclination angle θ1 and determines that the inclination angle θ1 is the relative angle. By executing the process of step S4, the controller 33 is used as a container posture detector. As described above, the controller 33 is used as the first extractor, the second extractor, and the container posture detector by executing the preset programs. That is, the first extractor, the second extractor, and the container posture detector are implemented as functional elements of the controller 33.

The operation of the present embodiment will now be described.

The controller 33 detects the relative angle between the forklift 10 and the container C in the vertical direction. The controller 33 controls the hydraulic mechanism 32 so as to reduce the difference between the inclination angle of the inner surface BWS with respect to the X-axis and the inclination angle of the upper surface of the fork 24 with respect to the X-axis. In detail, the controller 33 controls the supplying and discharging of hydraulic oil to and from the tilt cylinder 26 such that the tilt angle detected by the tilt angle sensor 36 coincides with the relative angle. In this control, the tilt angle does not have to be strictly the same as the relative angle, and errors resulting from the detection accuracy of the relative angle, the accuracy of tilting the loading device 21, or the like are allowed. That is, the difference between the inclination angle of the inner surface BWS with respect to the X-axis and the inclination angle of the upper surface of the fork 24 with respect to the X-axis simply needs to be reduced by tilting the loading device 21.

Tilting the loading device 21 as described above sets the upper surface of the fork 24 to be parallel or substantially parallel to the inner surface BWS. In this state, advancing the forklift 10 and inserting the fork 24 into the container C from the first opening O1 limits situations in which the distal end of the fork 24 and the cargo W contact the inner surface BWS. Further, when the fork 24 is lowered to load the cargo W onto the inner surface BWS, a part of the cargo W is prevented from being deviated toward the inner surface BWS and contacting the inner surface BWS. This limits situations in which the cargo W becomes unstable. That is, the container C can be loaded with the cargo W in the same manner as when the container C and the forklift 10 are arranged on the surfaces having the same inclination. Even if the difference in inclination between the surface on which the container C is arranged and the surface on which the forklift 10 is arranged or the loading situation of the cargo W causes the bottom BW (inner surface BWS) to be inclined with respect to the X-axis, the fork 24 can be inclined in accordance with the inclination. This allows the container C to be smoothly loaded with the cargo W regardless of the difference in inclination between the surface on which the container C is arranged and the surface on which the forklift 10 is arranged or the loading situation of the cargo W.

In the above-described example, the container C is loaded with the cargo W. The same control may also be performed when the cargo W is unloaded from the container C. Thus, even when the cargo W is unloaded from the container C, the fork 24 is tiltable in correspondence with the relative angle.

It may also be possible to detect the positions of the edges E1 and E2 by checking the shapes of the edges E1 and E2 against multiple radiation points P (point group) on the edges E1 and E2. However, in this case, it is difficult to identify whether the point group is on the edges E1 and E2 or on another structure. Additionally, when the distance from the distance meter 37 to each of the edges E1 and E2 is long, the point group needed to identify the shapes may not be able to be gained. The present embodiment allows the relative angle to be detected even if one radiation point P is on each of the edges E1 and E2.

The advantages of the embodiment will now be described.

(1) The controller 33 detects the relative angle between the forklift 10 and the container C in the vertical direction from the inclination of the straight line L. The straight line L is obtained by connecting the edge radiation points P1 and P2 on the edges E1 and E2. The edge radiation points P1 and P2 are extracted by checking the edge radiation point candidates P1 to P4 against the dimension information, the position information, and the posture information. The relative angle appears as the inclination of the straight line L. This allows the relative angle to be detected from the inclination of the straight line L.

(2) The controller 33 extracts the edge radiation points P1 and P2 as the posture detection points. It may also be possible to detect the relative angle from the radiation point P on the inner surface of the container C. However, like in the present embodiment, when the inner surface of the container C is a specular surface, the radiation point P on the inner surface of the container C may not be sufficiently obtained and the relative angle may not be detected. The edge radiation points P1 and P2 on the edges E1 and E2 are easily acquired. This allows the relative angle to be detected easily even if the inner surface of the container C is a specular surface.

(3) The straight line L is obtained by connecting the edge radiation points P1 and P2 on the edges E1 and E2. This allows the relative angle to be detected without arranging a marker on the container C.

(4) The controller 33 extracts the edge radiation points P1 and P2 by checking the edge radiation point candidates P1 to P4 against the dimension information, the position information, and the posture information. Accordingly, as compared with when the edge radiation points P1 and P2 are extracted by checking the edge radiation point candidates P1 to P4 against one of the dimension information, the position information, and the posture information, the edge radiation points P1 and P2 are extracted more accurately.

(5) The controller 33 extracts the edge radiation point candidates P1 to P4 from the inclinations of line segments each connecting adjacent ones of the radiation points P. This allows the edge radiation point candidates P1 to P4 to be extracted more accurately.

(6) The controller 33 extracts the edge radiation point candidates P1 to P4 and then extracts the edge radiation points P1 and P2. Accordingly, as compared with when it is determined whether all of the radiation points P are the edge radiation points P1 and P2 without extracting the edge radiation point candidates P1 to P4, the load on the controller 33 is reduced.

(7) In the method for detecting the posture of the container using the distance meter 37, the relative angle is detected from the inclination of the straight line L. Accordingly, the same advantages as advantages (1) to (6) are gained.

The present embodiment may be modified as follows. The present embodiment and the following modifications can be combined as long as the combined modifications remain technically consistent with each other.

The controller 33 may extract the edge radiation points P1 and P2 only from the result of checking the four edge radiation point candidates P1 to P4 against the dimension information. In this case, the memory 35 stores only the dimension information as the information of the container C. As described in the embodiment, the controller 33 calculates the separation distances of the edge radiation point candidates P1 to P4 from each other and compares the separation distances with the dimension d1 for all of the combinations of the four edge radiation point candidates P1 to P4. Thus, it can be determined that the edge radiation point candidates P1 and P2 or the edge radiation point candidates P3 and P4 are the edge radiation points. For example, the controller 33 extracts, as the edge radiation points P1 and P2, the ones of the edge radiation point candidates P1 and P2 and the edge radiation point candidates P3 and P4 that are closer to the forklift 10.

The controller 33 may extract the edge radiation points P1 and P2 from the result of checking the four edge radiation point candidates P1 to P4 against the dimension information and the position information. In this case, the memory 35 stores the dimension information and the position information as the information of the container C. The controller 33 determines from the dimension information that the edge radiation point candidates P1 and P2 or the edge radiation point candidates P3 and P4 are edge radiation points. When the edge radiation point candidates P1 and P2 or the edge radiation point candidates P3 and P4 are within a possible range of the distance from the forklift 10 to the edges E1 and E2 of the container C calculated from the position information, the controller 33 determines that the edge radiation point candidates within the possible range are the edge radiation points P1 and P2.

The controller 33 may extract the edge radiation points P1 and P2 from the result of checking the four edge radiation point candidates P1 to P4 against the dimension information and the posture information. In this case, the memory 35 stores the dimension information and the posture information as the information of the container C. The controller 33 determines from the dimension information that the edge radiation point candidates P1 and P2 or the edge radiation point candidates P3 and P4 are edge radiation points. The controller 33 acknowledges the orientation of the first opening O1 from the posture information. This allows the controller 33 to determine whether the edge radiation point candidates P1 and P2 or the edge radiation point candidates P3 and P4 are the edge radiation points P1 and P2 on the edges E1 and E2. Accordingly, the controller 33 can extract the edge radiation points P1 and P2.

The controller 33 may extract the edge radiation points P1 and P2 only from the result of checking the four edge radiation point candidates P1 to P4 against the position information. In this case, the memory 35 stores only the position information as the information of the container C. As described in the embodiment, the controller 33 uses the position information to calculate a possible range of the distance from the forklift 10 to each of the edges E1 and E2. The controller 33 can determine that the edge radiation point candidates P1 and P2 are the edge radiation points P1 and P2. Accordingly, the controller 33 can extract the edge radiation points P1 and P2.

The controller 33 may extract the edge radiation points P1 and P2 from the result of checking the four edge radiation point candidates P1 to P4 against the position information and the posture information. In this case, the memory 35 stores the position information and the posture information as the information of the container C. The controller 33 determines from the position information that the edge radiation point candidates P1 and P2 are the edge radiation points P1 and P2. Further, the controller 33 determines from the posture information that the edge radiation point candidates P1 and P2 or the edge radiation point candidates P3 and P4 are edge radiation points. In the example shown in FIG. 9, the controller 33 determines only from the position information that the edge radiation point candidates P1 and P2 are the edge radiation points P1 and P2. However, when several radiation points P are on an obstacle, the edge radiation points P1 and P2 may not be able to be determined only from the position information. In such a case, the posture information is used to determine the edge radiation points P1 and P2. Accordingly, the controller 33 can extract the edge radiation points P1 and P2.

The controller 33 may extract the edge radiation points P1 and P2 only from the result of checking the four edge radiation point candidates P1 to P4 against the posture information. In this case, the memory 35 stores only the posture information as the information of the container C. The controller 33 determines that the edge radiation point candidates P1 and P2 or the edge radiation point candidates P3 and P4 are edge radiation points. For example, the controller 33 extracts, as the edge radiation points P1 and P2, the ones of the edge radiation point candidates P1 and P2 and the edge radiation point candidates P3 and P4 that are closer to the forklift 10.

As described above, the controller 33 extracts the edge radiation points P1 and P2 by checking the edge radiation point candidates P1 to P4 against one or two of the dimension information, the position information, and the posture information. Whether the edge radiation points P1 and P2 can be extracted by checking the edge radiation point candidates P1 to P4 against one or two of the dimension information, the position information, and the posture information depends on the surrounding environment of the container C. The larger the number of pieces of information used for checking against the edge radiation point candidates P1 to P4, the less dependent the controller 33 is on the surrounding environment to extract the edge radiation points P1 and P2. Thus, the information used to extract the edge radiation points P1 and P2 simply needs to be selected according to the surrounding environment of the container C.

Figure 10:
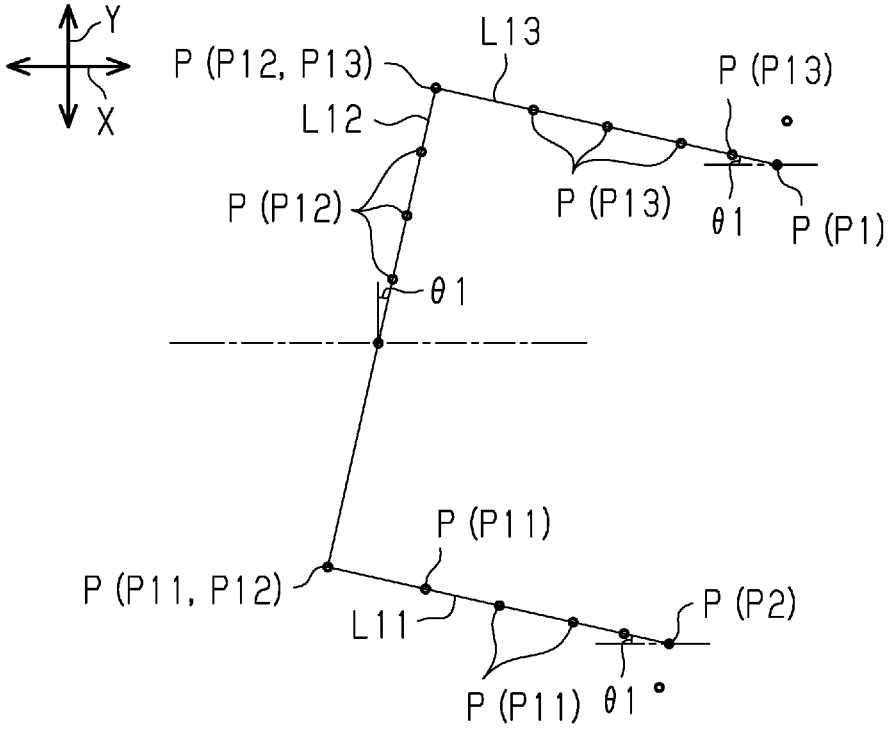
FIG. 10 is a diagram schematically showing radiation points when a laser is radiated to the container in FIG. 5.

As shown in FIG. 10, the detection point candidates may belong to any group of inner surface radiation point candidates P11, P12, and P13, which are the candidates of the groups of radiation points P11, P12, and P13. The group of the inner surface radiation points P11 includes radiation points P on the inner surface BWS. The group of the inner surface radiation points P12 includes radiation points P on an inner surface RWS. The group of the inner surface radiation points P13 includes radiation points P on an inner surface CWS. In the example shown in FIG. 10, the inner surface radiation point candidates P11, P12, and P13 respectively correspond to the inner surface radiation points P11, P12, and P13. As the container C inclines in the front-rear direction with respect to the vertical direction, the inner surfaces BWS, RWS, and CWS of the inner surfaces of the container C incline in the vertical direction in accordance with the inclination of the container C. Thus, the inclination of a straight line connecting any two of the inner surface radiation points P11 follows the inclination of the container C in the vertical direction. Accordingly, the inner surface radiation points P11 may be posture detection points. In the same manner, the inclination of the straight line connecting any two of the inner surface radiation points P12 and the inclination of the straight line connecting any two of the inner surface radiation points P13 change in accordance with the inclination of the container C in the vertical direction. Thus, the inner surface radiation points P12 and the inner surface radiation points P13 may be posture detection points. A single pair and multiple pairs of the radiation points P serving as posture detection points can be extracted.

The controller 33 can detect the relative angle by extracting any one of the groups of the inner surface radiation points P11, P12, and P13 and obtaining a straight line from multiple point groups on the same surface. The detail will be described below.

The controller 33 extracts any one of the groups of the radiation point candidates P11, P12, and P13. That is, the controller 33 simply needs to extract the candidates of inner surface radiation points on the inner surface of at least any one of the bottom BW, the rear wall RW1, the real wall RW2, and the ceiling CW. The controller 33 may extract one or more groups of the inner surface radiation point candidates P11, P12, and P13. The inner surface radiation point candidates may be extracted using various modes. In many cases, the group of the radiation points P on each of the inner surfaces BWS, RWS, and CWS is laid out in a single row along the corresponding inner surface. Thus, the controller 33 can extract, as a group of inner surface radiation point candidates, the radiation points P that are regarded as being laid out in a single row. For example, an inner surface determination threshold value related to the change amount of the inclination of a line segment connecting adjacent radiation points P may be set, and the radiation points P where the change amount of the inclination of the line segment is within the inner surface determination threshold value may be extracted as a group of inner surface radiation point candidates. The inner surface BWS of the bottom BW and the inner surface CWS of the ceiling CW in the inner surfaces of the container C perpendicularly intersect the inner surface RWS of the rear walls RW1 and RW2. Thus, a line segment connecting two inner surface radiation points P11 on the inner surface BWS and a line segment connecting two inner surface radiation points P12 on the inner surface RWS have inclinations that greatly differ from each other. In the same manner, a line segment connecting two inner surface radiation points P12 on the inner surface RWS and a line segment connecting two inner surface radiation points P13 on the inner surface CWS have inclinations that greatly differ from each other. The controller 33 determines whether the inner surface radiation point candidates of the radiation points P laid out in a single row have been radiated to the inner surface BWS, RWS, or CWS from the inclination of the line segment connecting any two of the radiation points P. That is, the controller 33 can individually extract the inner surface radiation point candidates P11 on the inner surface BWS, the inner surface radiation point candidates P13 on the inner surface CWS, and the inner surface radiation point candidates P12 on the inner surface RWS.

Instead, the controller 33 may extract the inner surface radiation point candidates P11 and P13 from the separation distances between the radiation points P. For example, the inner surface radiation points P13 on the inner surface CWS and the inner surface radiation points P11 on the inner surface BWS have differences in Y-coordinates by an amount corresponding to the dimension between the inner surface CWS and the inner surface BWS. Accordingly, when the difference in Y-coordinates between two of the radiation points P that are spaced apart from each other in the Y-axis is regarded as the dimension between the inner surface CWS of the ceiling CW and the inner surface BWS of the bottom BW, these two radiation points P may be regarded as a combination of the inner surface radiation point P11 and the inner surface radiation point P13.

The controller 33 extracts the radiation points P11, P12, and P13 from the inner surface radiation point candidates P11, P12, and P13, respectively. The controller 33 may extract one or more groups of the inner surface radiation points P11, P12, and P13. The inner surface radiation points P11, P12, and P13 are extracted by checking the inner surface radiation point candidates P11, P12, and P13 against at least one of the dimension information, the position information, and the posture information stored in the memory 35. That is, the controller 33 may extract the inner surface radiation points P11, P12, and P13 using one of the dimension information, the position information, and the posture information or may extract the inner surface radiation points P11, P12, and P13 by combining two or more of the dimension information, the position information, and the posture information. In the following description, a case where the inner surface radiation points P11 on the bottom BW are extracted will be described as an example. The inner surface radiation points P12 radiated to the rear walls RW1 and RW2 and the inner surface radiation points P13 radiated to the ceiling CW can also be extracted in the same manner.

The controller 33 compares the difference between the length of a line segment obtained by connecting the inner surface radiation point candidates P11 and the dimension of the bottom BW in the front-rear direction indicated by the dimension information. When the difference between the dimension of the bottom BW in the front-rear direction and the length of the line segment obtained from the inner surface radiation point candidates P11 is within an allowable range, the inner surface radiation point candidates P11 are extracted as the inner surface radiation point P11. The allowable range is set taking into account, for example, the measurement accuracy of the length of the line segment and the fact that the container C includes a specular surface.

The controller 33 compares the distance from the forklift 10 to each of the edge radiation point candidates P11 with the position of the container C indicated by the position information. The controller 33 uses the position information to calculate a possible range of the distance from the forklift 10 to the rear end of the bottom BW. The controller 33 extracts, as the inner surface radiation points P11, the inner surface radiation point candidates P11 that are within a possible range of the distance.

The controller 33 calculates the inclination of a line segment obtained by the inner surface radiation point candidates P11. The controller 33 is capable of acknowledging the possible range of the inclination angle of the line segment connecting the inner surface radiation points P11 from the posture information. When the inclination angle of the line segment connecting the inner surface radiation point candidates P11 is within a possible range of the inclination angle of the line segment connecting the inner surface radiation points P11, these inner surface radiation point candidates P11 are extracted as the inner surface radiation points P11.

As described above, the controller 33 is capable of extracting the inner surface radiation points P11, P12, and P13 using one of the dimension information, the position information, and the posture information. Further, by extracting the inner surface radiation points P11, P12, and P13 using two or more of the dimension information, the position information, and the posture information, the controller 33 is capable of extracting the inner surface radiation points P11, P12, and P13 without depending on the surrounding environment. Thus, the information used to extract the inner surface radiation points P11, P12, and P13 simply needs to be selected according to the surrounding environment of the container C.

Upon extracting any one of the groups of the inner surface radiation points P11, P12, and P13, the controller 33 detects the relative angle from the inclination of a straight line obtained from that group. When a straight line L11 obtained from the inner surface radiation points P11 on the inner surface BWS is used, the inclination angle θ1 obtained from the inclination of the straight line L11 with respect to the X-axis is the relative angle. When a straight line L12 obtained from the inner surface radiation points P12 on the inner surface RWS is used, the inclination angle θ1 obtained from the inclination of the straight line L12 with respect to the Y-axis is the relative angle. When a straight line L13 obtained from the inner surface radiation points P13 on the inner surface CWS is used, the inclination angle θ1 of the straight line L13 with respect to the X-axis is the relative angle. When two or more groups of the inner surface radiation points P11, P12, and P13 are extracted and two or more straight lines L (two or more of L11, L12, and L13) are obtained, the inclination angle θ1 is obtained by an amount corresponding to the number of the obtained straight lines L. In this case, the controller 33 may select any inclination angle θ1 from multiple inclination angles θ1 or may calculate the average value of multiple inclination angles θ1 and set the average value as the relative angle.

The controller 33 may extract both the edge radiation points P1 and P2 and a group of inner surface radiation points (any one of the groups of P11, P12, and P13) and calculate both the inclination of a first straight line L obtained from the edge radiation points P1 and P2 and the inclination of a second straight line (any one of L11, L12, and L13) obtained from the inner surface radiation points. In this case, the controller 33 may calculate the average value of a first inclination angle θ1 calculated from the inclination of the first straight line L and a second inclination angle θ1 calculated from the inclination of the second straight line L and set the average value as the relative angle. Alternatively, the controller 33 may select one of the first inclination angle θ1 and the second inclination angle θ1.

When failing to extract the edge radiation points P1 and P2, the controller 33 may extract a group of inner surface radiation points (any one of the groups of P11, P12, and P13) and calculate the relative angle from that group of inner surface radiation points. Alternatively, when failing to extract any one of the groups of inner surface radiation points, the controller 33 may extract the edge radiation points P1 and P2 and calculate the relative angle from the edge radiation points P1 and P2. As described above, the controller 33 simply needs to extract at least the edge radiation points P1 and P2 or a group of inner surface radiation points from the radiation points P and detect the relative angle from at least two of the extracted posture detection points.

As described above in the embodiment, when the inner surface of the container C is a specular surface, the controller 33 may not sufficiently obtain the radiation points P on the inner surface of the container C. Accordingly, when the controller 33 detects the relative angle from a group of inner surface radiation points (any one of the groups of P11, P12, and P13), it is desired that a container without a specular inner surface be used.

The controller 33 may calculate the relative angle from the inclination of a third straight line, which differs from the first straight line L obtained from the edge radiation points P1 and P2 and the second straight line obtained from the inner surface radiation points. For example, the controller 33 may calculate the relative angle from the inclination of a straight line connecting the edge radiation point P1 and the edge radiation point candidate P4.

The controller 33 does not have to extract the edge radiation point candidates P1 to P4 using the inclination of a line segment. Instead, for example, the controller 33 may determine that three radiation points P where line segments connecting adjacent radiation points P intersect at a predetermined angle or larger are edge radiation point candidates.

When checking detection point candidates against the dimension information, the position information, and the posture information, as long as the controller 33 extracts the edge radiation points P1 and P2 before checking all of the edge radiation point candidates P1 to P4, the controller 33 may end the extracting of the edge radiation points P1 and P2 at the point in time the edge radiation points P1 and P2 have been extracted. That is, in some cases, all of the edge radiation point candidates P1 to P4 do not have to be checked against the dimension information, the position information, and the posture information.

The distance meter 37 may be attached at any position as long as a radiated laser does not strike the loading device 21 and the distance meter 37 does not rise, fall, or tilt together with the loading device 21. For example, the distance meter 37 may be attached to the vehicle body 11 or the head guard 16.

The distance meter 37 may be a three-dimensional laser rangefinder capable of changing the radiation angle of a laser with respect to the horizontal direction in addition to the radiation angle of a laser with respect to the vertical direction.

The forklift 10 may be operated manually by the occupant or may be switchable between automatic operation and manual operation. In this case, the controller 33 displays the relative angle on a display section viewable by the occupant. The occupant is able to acknowledge the relative angle from the display of the display section and thus operate the forklift 10 and tilt the loading device 21 such that the upper surface of the fork 24 is parallel to the inner surface BWS of the bottom BW.

The controller that detects the relative angle may be arranged separately from the controller that operates the forklift 10 by controlling the driving mechanism 31 and the hydraulic mechanism 32.

The first extractor, the second extractor, and the container posture detector may be implemented as the functional units of an individual controller.

The container C does not have to be a container for refrigeration use. Even this modification achieves the same advantages as the embodiment.

The forklift 10 may be, for example, a reach forklift or may be of any type.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

The invention claimed is:

1. A forklift comprising:

a vehicle body;

a loading device capable of being tilted toward the vehicle body;

a laser rangefinder configured to radiate a laser toward a front side of the loading device while changing a radiation angle with respect to a vertical direction and measure, in correspondence with the radiation angle, a distance to each of radiation points in a group of radiation points that have been struck by the laser;

a first extractor configured to extract detection point candidates from the group of radiation points in a load state in which a container on the front side of the loading device is loaded with a cargo, wherein the detection point candidates are candidates of at least two posture detection points, an inclination of a straight line connecting the posture detection points changes in accordance with an inclination of the container in the vertical direction;

a memory that stores at least one of dimension information of the container, position information of the container, and posture information of the container;

a second extractor configured to extract the posture detection points from the detection point candidates by checking the detection point candidates against at least one of the dimension information, the position information, and the posture information; and a container posture detector configured to detect a relative angle between the forklift and the container in the vertical direction from the inclination of the straight line.

2. The forklift according to claim 1, wherein the container includes four edges that define an opening, the cargo being taken out of and put into the opening, the four edges include two edges spaced apart from each other in the vertical direction, the at least two posture detection points include two edge radiation points that are respectively located on the two edges, and the detection point candidates include edge radiation point candidates, the edge radiation point candidates being candidates of the edge radiation points.

3. The forklift according to claim 1, wherein the second extractor is configured to extract the posture detection points by checking the detection point candidates against two or more of the dimension information, the position information, and the posture information.

4. The forklift according to claim 1, wherein the first extractor is configured to extract the detection point candidates from inclinations of line segments each connecting adjacent ones of the radiation points of the group of radiation points.

5. A method for detecting a posture of a container, the method detecting a relative angle between a forklift and the container in a vertical direction, the method comprising:

radiating a laser from the forklift toward the container while changing an radiation angle with respect to the vertical direction and measuring, in correspondence with the radiation angle, a distance to each of radiation points in a group of radiation points that have been struck by the laser;

extracting detection point candidates from the group of radiation points;

extracting at least two posture detection points from the detection point candidates by checking the detection point candidates against at least one of dimension information of the container, position information of the container, and posture information of the container, wherein an inclination of a straight line connecting the posture detection points changes in accordance with an inclination of the container in the vertical direction; and detecting the relative angle between the forklift and the container in the vertical direction from the inclination of the straight line.

6. The method according to claim 5, wherein the container includes four edges that define an opening, a cargo being taken out of and put into the opening, the four edges include two edges spaced apart from each other in the vertical direction, the at least two posture detection points include two edge radiation points that are respectively located on the two edges, and the posture detection points include edge radiation point candidates, the edge radiation point candidates being candidates of the edge radiation points.

7. The method according to claim 5, wherein extracting the posture detection points includes checking the detection point candidates against two or more of the dimension information, the position information, and the posture information.

8. The method according to claim 5, wherein extracting the detection point candidates includes extracting the detection point candidates from inclinations of line segments each connecting adjacent ones of the radiation points of the group of radiation points.

* * * * *